US008047823B2

(12) United States Patent
Takei

(10) Patent No.: US 8,047,823 B2
(45) Date of Patent: Nov. 1, 2011

(54) SCROLL-TYPE FLUID MACHINE INCLUDING PRESSURE-RECEIVING PIECE

(75) Inventor: Yuji Takei, Takasaki (JP)

(73) Assignee: Sanden Corporation, Isesaki (JP)

( * ) Notice: Subject to any disclaimer, the term of this patent is extended or adjusted under 35 U.S.C. 154(b) by 409 days.

(21) Appl. No.: 12/297,718

(22) PCT Filed: Apr. 10, 2007

(86) PCT No.: PCT/JP2007/057866

§ 371 (c)(1),
(2), (4) Date: Oct. 20, 2008

(87) PCT Pub. No.: WO2007/123016

PCT Pub. Date: Nov. 1, 2007

(65) Prior Publication Data

US 2009/0202376 A1 Aug. 13, 2009

(30) Foreign Application Priority Data

Apr. 21, 2006 (JP) ..... 2006-117820

(51) Int. Cl.
*F03C 2/00* (2006.01)
*F03C 4/00* (2006.01)
*F04C 18/00* (2006.01)

(52) U.S. Cl. ..... 418/55.5; 418/55.1; 418/55.6; 418/57; 184/6.18

(58) Field of Classification Search ..... 418/55.1–55.6, 418/57, 152, 178, 179, 270; 184/6.16–6.18
See application file for complete search history.

(56) References Cited

U.S. PATENT DOCUMENTS

| | | | | |
|---|---|---|---|---|
| 4,696,628 | A * | 9/1987 | Kimura et al. | 418/55.1 |
| 5,147,192 | A * | 9/1992 | Suzuki et al. | 418/55.3 |
| 6,860,729 | B2 | 3/2005 | Sowa et al. | |
| 2005/0220651 | A1 * | 10/2005 | Tsukamoto et al. | 418/55.1 |

FOREIGN PATENT DOCUMENTS

| | | |
|---|---|---|
| JP | 56-141087 | 11/1981 |
| JP | 64-66484 | 3/1989 |
| JP | 1-76584 | 5/1989 |
| JP | 1-219379 | 9/1989 |
| JP | 3-92579 | 9/1991 |
| JP | 6-167284 | 6/1994 |
| JP | 2000-257558 | 9/2000 |
| JP | 2000-257572 | 9/2000 |
| JP | 2005-248925 | 9/2005 |
| JP | 2005-291151 | 10/2005 |
| JP | 2005-307949 | 11/2005 |

* cited by examiner

*Primary Examiner* — Theresa Trieu
(74) *Attorney, Agent, or Firm* — Cozen O'Connor

(57) ABSTRACT

A scroll-type fluid machine has a movable scroll (50) that forms pressure chambers (52) in between the movable scroll (50) and a fixed scroll (40) and is orbitable relative to the fixed scroll (40), a support wall (14) that is provided for the housing (10) and supports thrust load transmitted from the movable scroll (50), and a thrust bearing (74) disposed in between the movable scroll (50) and the support wall (14). The thrust bearing (74) includes a ring-shaped support face (64) formed in the support wall (14), a retention plate (76) fixed onto the support face (64), a retention hole (86) that is formed in the retention plate (76) and opens in both faces of the retention plate (76), and a pressure-receiving piece (88) retained in a retention hole (86) and brought into surface contact with both the support face (64) and the movable scroll (50).

10 Claims, 5 Drawing Sheets

SCROLL-TYPE FLUID MACHINE INCLUDING PRESSURE-RECEIVING PIECE

RELATED APPLICATIONS

This is a U.S. National Phase Application under 35 USC 371 of International Application PCT/JP2007/0557866 filed on Apr. 10, 2007.

This application claims the priority of Japanese patent application no. 2006-117820 filed Apr. 21, 2006, the content of which is hereby incorporated by reference.

TECHNICAL FIELD

The present invention relates to a scroll-type fluid machine, and more specifically, to a thrust-receiving structure.

BACKGROUND ART

For example, a scroll-type fluid machine that is applied as a compressor of a refrigeration circuit has fixed and movable scrolls in a housing. The fixed and movable scrolls form pressure chambers in consort with each other.

The movable scroll is caused to make an orbiting movement relative to the fixed scroll. In response to this orbiting movement, a refrigerant (working fluid) within the refrigeration circuit is drawn into the pressure chamber and compressed in the pressure chamber. The compressed refrigerant is subsequently discharged from the pressure chamber through a discharge port of the compressor toward a condenser of the refrigeration circuit.

In the refrigerant compression process, the pressure of the refrigerant in the pressure chamber becomes high, so that the movable scroll is applied with high thrust load. This thrust load acts to move the movable scroll away from the fixed scroll in its axis direction.

Such thrust load hampers the smooth orbiting movement of the movable scroll. The compressor is therefore provided with a thrust-receiving device, namely a thrust bearing, in between a support surface of the housing and the movable scroll. The scroll-type fluid machines disclosed in Unexamined Japanese Patent Application Publication Nos. 2005-248925, 2005-291151 and 2005-307949 each have a plurality of pressure-receiving pieces serving as a thrust bearing, the pieces being arranged in a circumferential direction. Each pressure-receiving piece is retained in a retention hole or groove that is formed in the support surface of the housing.

In each of the scroll-type fluid machines disclosed in the publications, it is necessary to dispose the pressure-receiving pieces parallel to the base plate of the movable scroll and to make the sliding surfaces of the pressure-receiving pieces, which come into sliding contact with the movable scroll, flush with one another for the purpose of preventing a fracture, abrasion, seizure or the like of the pressure-receiving pieces.

To that end, the bottom faces of the retention holes or grooves formed in the support wall also have to be parallel to the base plate of the movable scroll and located at the same distance from the base plate of the movable scroll.

The pressure-receiving pieces slide against the bottom faces of the retention holes or grooves as well, so that the bottom faces of the retention holes or grooves are also polished so that surface roughness is small. On the other hand, it is difficult and costly in manufacture to carry out the machining and grinding so that the bottom faces of the retention holes or grooves are located at the same distance from the base plate of the movable scroll, or in other words, so that the retention holes or grooves have a fixed depth.

DISCLOSURE OF THE INVENTION

The present invention has been made in light of the above-mentioned circumstances. It is an object of the invention to provide a scroll-type fluid machine including a thrust-receiving device in which sliding surfaces of pressure-receiving pieces, which come into sliding contact with a movable scroll, are arranged to be flush with one another with a simple structure, and a good sliding ability is secured.

In order to accomplish the object, the scroll-type fluid machine of the invention has a fixed scroll that is fixed in a housing with an intake port and a discharge port, a movable scroll that forms pressure chambers in between the movable and fixed scrolls and is orbitable relative to the fixed scroll, a support wall that is provided for the housing and supports thrust load transmitted from the movable scroll, and a thrust-receiving device that is disposed in between the movable scroll and the support wall. The thrust-receiving device includes a ring-shaped support face formed in the support wall, a retention plate fixed onto the support face, a retention hole that is formed in the retention plate and opens into both faces of the retention plate, and a pressure-receiving piece that is retained in the retention hole and comes into surface contact with both the support face and the movable scroll.

In the thrust-receiving device used in the scroll-type fluid machine of the invention, the pressure-receiving piece is brought into surface contact with the support face of the support wall and the movable scroll in a state retained in the retention hole of the retention plate. This eliminates the necessity of forming the retention hole or groove with a fixed depth in the support face. As long as the support face is ground flat, the sliding faces of the pressure-receiving pieces, which come into sliding contact with the movable scroll, can be arranged flush with one another. Consequently, the thrust-receiving device of the fluid machine is capable of uniformly applying thrust load transmitted from the movable scroll to the pressure-receiving pieces, to prevent a fracture, abrasion, seizure or the like of the pressure-receiving pieces, and to secure a good sliding ability with a simple structure.

Preferably, the housing includes a scroll casing that is airtightly connected to the support wall with an O-ring interposed therebetween and accommodates the fixed scroll, and the retention plate is formed in a shape of a ring and has an outer circumferential portion pressing the O-ring.

In the thrust-receiving device used in the preferable scroll-type fluid machine, the retention plate is formed in the shape of a ring, and the O-ring is pressed down with the outer circumferential portion of the retention plate, thereby simplifying a form of a ring groove accommodating the O-ring, which is provided to the support wall or the scroll casing. The fluid machine is then easy to be manufactured and sold at a low price.

Preferably, the housing further includes a drive casing that is airtightly connected to the scroll casing through the support wall and encloses at least a part of a rotary shaft that transmits motive power for causing the movable scroll to make orbiting movement; the intake port is formed in the drive casing; and the scroll-type fluid machine further has a communication hole extending through the support wall and the retention plate.

In a preferable scroll-type fluid machine, working fluid smoothly flows around the fixed and movable scrolls through the communication hole, and is then efficiently supplied into the pressure chamber. Lubricating oil contained in the working fluid is also sufficiently supplied to the fixed and movable scrolls, so that a sliding part between the scrolls is efficiently lubricated. The fluid machine therefore maintains durability and reduces power consumption.

Preferably, the housing further includes a drive casing that is airtightly connected to the scroll casing through the support wall and encloses at least a part of a rotary shaft that transmits motive power for causing the movable scroll to make orbiting movement; the intake port is formed in the drive casing; the support wall has a shaft hole inserted with a boss of the movable scroll from one side and an end of the rotary shaft from the other side, a reduced bore portion that is formed in the other side of the shaft hole, the reduced bore portion to which a bearing for supporting the rotary shaft is fixed, and a lubricating-oil supply hole extending through the reduced bore portion.

In a preferable scroll-type fluid machine, the lubricating oil is smoothly supplied to a joint part between the boss and the rotary shaft through the lubricating-oil supply hole. The fluid machine therefore maintains durability and reduces power consumption.

Preferably, the retention plate is made of resin.

In a preferable scroll-type fluid machine, as the retention plate is made of resin, the retention plate is easy to be molded. The fluid machine is then easy to be manufactured and sold at a low price. The resin retention plate is light in weight, and contributes to weight saving of the fluid machine. A vehicle or the like employing this fluid machine is improved in fuel consumption.

BEST MODE OF CARRYING OUT THE INVENTION

Figure 1:
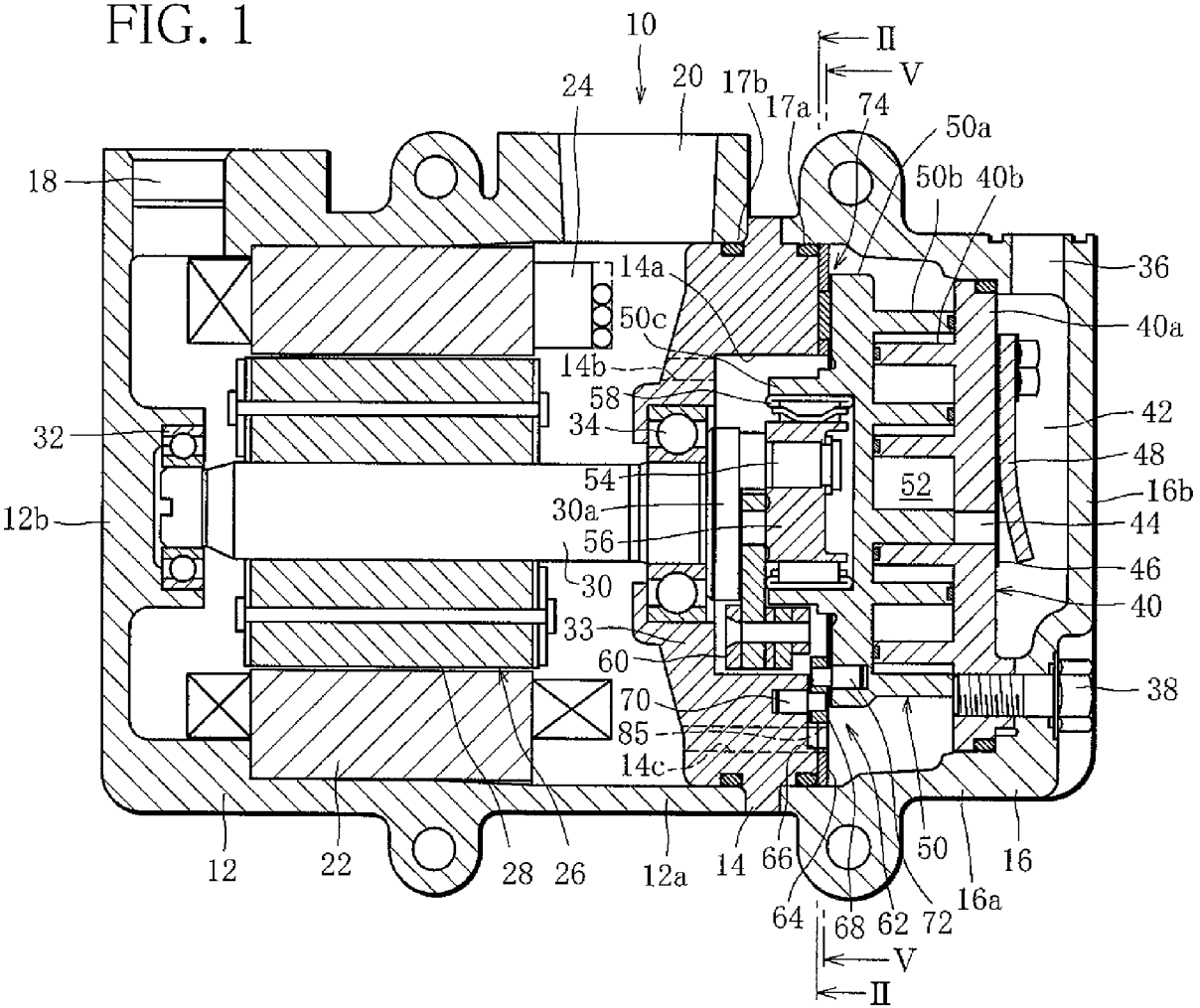
FIG. 1 is a longitudinal sectional view showing a compressor as a scroll-type fluid machine.

FIG. 1 shows a compressor serving as a scroll-type fluid machine according to an embodiment. This compressor is installed, for example, in a refrigeration circuit of a vehicle airconditioning system and is used to compress a refrigerant (working fluid) in the refrigeration circuit. The refrigerant contains refrigerating machine oil working as lubricating oil. The refrigerating machine oil is supplied to bearings and various sliding surfaces in the compressor together with the refrigerant, to thereby lubricate these bearings and sliding surfaces.

The compressor includes a substantially cylindrical housing 10. The housing 10 has a drive casing (motor casing) 12, a support wall 14 and a scroll casing 16 arranged in the order from left to right as viewed into FIG. 1. The drive casing 12 and the scroll casing 16 are coupled together with the support wall 14 interposed therebetween. O-rings 17*a* and 17*b* are set in between an outer circumferential wall 16*a* of the casing 16 and the support wall 14, and between an outer circumferential wall 12*a* of the casing 12 and the support wall 14.

In the outer circumferential wall 12*a* of the drive casing 12, an intake port 18 is formed in an end wall 12*b* side of the drive casing 12. The intake port 18 is connected to a low-pressure side of the refrigeration circuit. A power supply port 20 is formed on the support wall 14 side of the outer circumferential wall 12*a*. The power supply port 20 is closed with a power supply plug, not shown.

A cylindrical stator 22 is fixed in an inner circumferential surface of the outer circumferential wall 12*a*. The stator 22 is located in between the intake port 18 and the power supply port 20. The stator 22 is wound with a coil 24. A lead wire, not shown, is drawn out from the coil 24 and extends airtightly through the power supply plug. The coil 24 can then be externally supplied with power through the lead wire.

An armature 26 is placed radially inside the stator 22. The armature 26 has a cylindrical core 28 made of laminated electromagnetic steel sheets and a rotary shaft 30 extending through the center of the core 28. When the coil 24 is supplied with power, the rotary shaft 30 is allowed to rotate integrally with the core 28.

The rotary shaft 30 extends from the end wall 12*b* of the drive casing 12 to the support wall 14. The rotary shaft 30 has an end on the end wall 12*b* side, which is rotatably supported by a radial bearing 32 placed in a bearing hole of the end wall 12*b*. A shaft hole 14*a* is formed through the center of the support wall 14. The rotary shaft 30 includes a large-diameter end portion 30*a* that is seated in the shaft hole 14*a*. A reduced bore portion (boss) 33 having a smaller bore than the scroll casing 16 side is formed in the drive casing 12 side of the shaft hole 14*a*. A radial bearing 34 is placed in the inside of the reduced bore portion 33. The radial bearing 34 supports a part of the rotary shaft 30, which is located near the large-diameter end portion 30*a*, so that the rotary shaft 30 is rotatable.

It is preferable that a lubricating-oil supply hole 14*b* should be formed in the support wall 14 so as to extend through the reduced bore portion 33. The lubricating-oil supply hole 14*b* opens in a step surface located inside the shaft hole 14*a*. It is also preferable that the support wall 14 should include a plurality of communication holes 14*c* extending through an outer circumferential portion thereof.

A discharge port 36 is formed in the outer circumferential wall 16*a* of the scroll casing 16 to be located in the end wall 16*b* side of the scroll casing 16. The discharge port 36 leads to a high-pressure side of the refrigeration circuit. A fixed scroll 40 is fixed in the scroll casing 16 with a fastening bolt 38. A discharge chamber 42 is marked off between a base plate 40*a* of the fixed scroll 40 and the end wall 16*b*. The discharge port 36 opens into the discharge chamber 42.

An O-ring is set in between an outer circumferential portion of the base plate 40*a* of the fixed scroll 40 and the outer circumferential wall 16*a* of the scroll casing 16. In the center of the base plate 40*a*, there is formed a discharge hole 44. The discharge hole 44 is opened and closed with a lead valve 46. Opening angle of the lead valve 46 is regulated by a valve guard 48. The lead valve 46 and the valve guard 48 are fixed onto a back face of the base plate 40*a* that partitions off the discharge chamber 42.

The fixed scroll 40 has an involute wall 40*b* that is formed integrally with the base plate 40*a* so as to be arranged in the support wall 14 side. The fixed scroll 40 is engaged with the movable scroll 50 having a base plate 50*a* and an involute wall 50*b*. The involute walls 40*b* and 50*b* have shapes defined by involute curves. Accordingly, a plurality of pressure chambers 52 are formed in between the fixed scroll 40 and the movable scroll 50, and the movable scroll 50 is orbitable relative to the fixed scroll 40.

The pressure chambers 52 are created in a radial outside of the fixed and movable scrolls 40 and 50 along with the orbiting movement of the movable scroll 50. The pressure chambers 52 move into a radial inside of the scrolls 40 and 50 while diminishing in capacity at the same time, and then disappear at a radial center of the scrolls 40 and 50. Working fluid is drawn into the pressure chambers 52 from the radial outside. When the pressure chambers 52 reach the radial center, the working fluid in the pressure chambers 52 has pressure higher than a shutoff pressure of the lead valve 46. In result, the working fluid within the pressure chambers 52 is discharged into the discharge chamber 42.

The fixed and movable scrolls 40 and 50 are made, for example, of aluminum alloy. In the surfaces of the scrolls 40 and 50, alumite films are formed by alumite treatment. Tip seals are arranged in edges of the involute walls 40*b* and 50*b*. The tip seals come into sliding contact with the base plates 50*a* and 40*a* of the opposite scrolls 50 and 40 that make relative orbiting movement.

The movable scroll 50 and the rotary shaft 30 are coupled to each other through a conversion mechanism for converting the rotational movement of the rotary shaft 30 into the orbiting movement of the movable scroll 50.

To be more specific, a crank pin 54 is protruding from the large-diameter portion 30*a* of the rotary shaft 30 toward the movable scroll 50. The crank pin 54 is mounted with an eccentric bushing 56. The base plate 50*a* of the movable scroll 50 is located near the support wall 14. A boss 50*c* is formed integrally and concentrically in a back face of the base plate 50*a* on the support wall 14 side. The boss 50*c* is projecting from the back face of the base plate 50*a* into the shaft hole 14*a* of the support wall 14 and receives the eccentric bushing 56 inside. A needle bearing 58 is disposed in between an inner circumferential surface of the boss 50*c* and an outer circumferential surface of the eccentric bushing 56. The needle bearing 58 connects the eccentric bushing 56 and the movable scroll 50 to each other so as to allow a relative rotation.

The eccentric bushing 56 is attached with a counter weight 60, which stabilizes the orbiting movement of the movable scroll 50.

A plurality of rotation stoppers 62 are formed in between the movable scroll 50 and the support wall 14. The rotation stoppers 62 prevent the movable scroll 50 from rotating around its own axis during the orbiting movement of the movable scroll 50.

Figure 2:
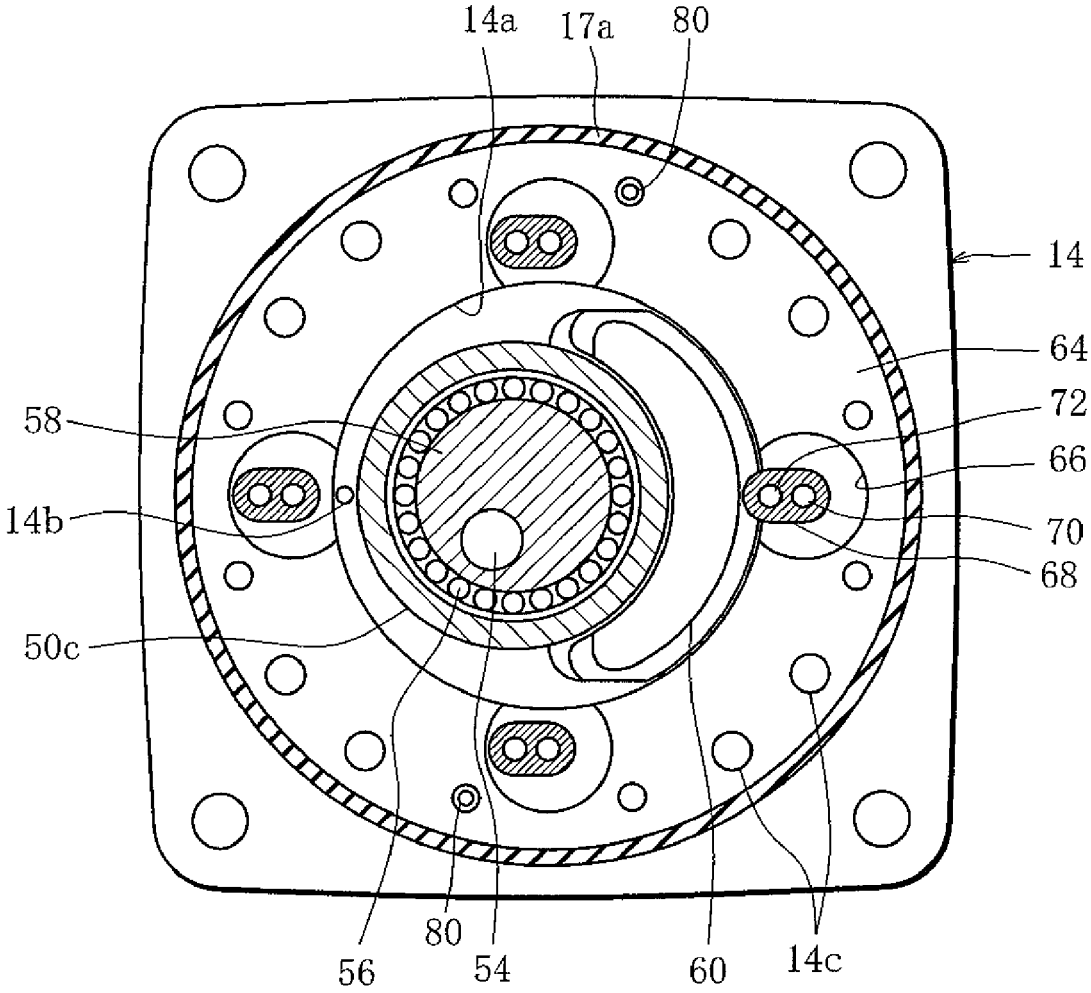
FIG. 2 is a cross sectional view, taken along line II-II of FIG. 1.

More concretely, as illustrated in FIG. 2, the support wall 14 has a ring-shaped support face 64. The support face 64 faces an outer circumferential portion of the base plate 50*a* of the movable scroll 50. In the support face 64, substantially circular-shaped recesses 66 are arranged at equal circumferential intervals of 90 degrees in angle. Each of the rotation stoppers 62 has a link member 68 that is seated in the corresponding recess 66. The link member 68 is relatively rotatably connected to the support wall 14 with a first link pin 70 projecting from the center of a bottom face of the recess 66. The link member 68 is relatively rotatably coupled to the movable scroll 50 with a second link pin 72 projecting from the base plate 50*a* of the movable scroll 50.

Figure 3:
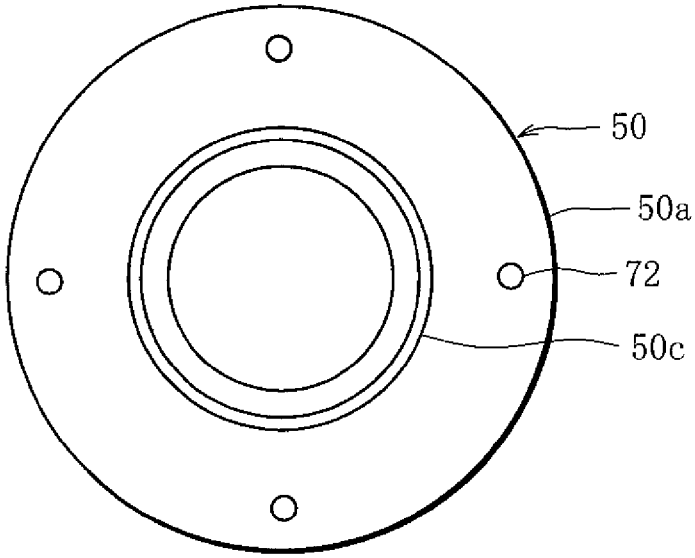
FIG. 3 is a rear view showing a movable scroll that is applied to the compressor shown in FIG. 1 and is attached with second link pins.

As illustrated in FIG. 3, the second link pins 72 are concentrically disposed in a radially more external part than the boss 50*c*. The first and second link pins 70 and 72 are parallel to an axis of the rotary shaft 30 and separated away from each other in a radial direction of the corresponding recess 66. As the movable scroll 50 makes the orbiting movement, the link members 68 of the rotation stoppers 62 rotates around the first link pins 70 within the recesses 66, respectively, to thereby block an axial rotation of the movable scroll 50 connected to the link member 68 through the second link pin 72.

Figure 4:
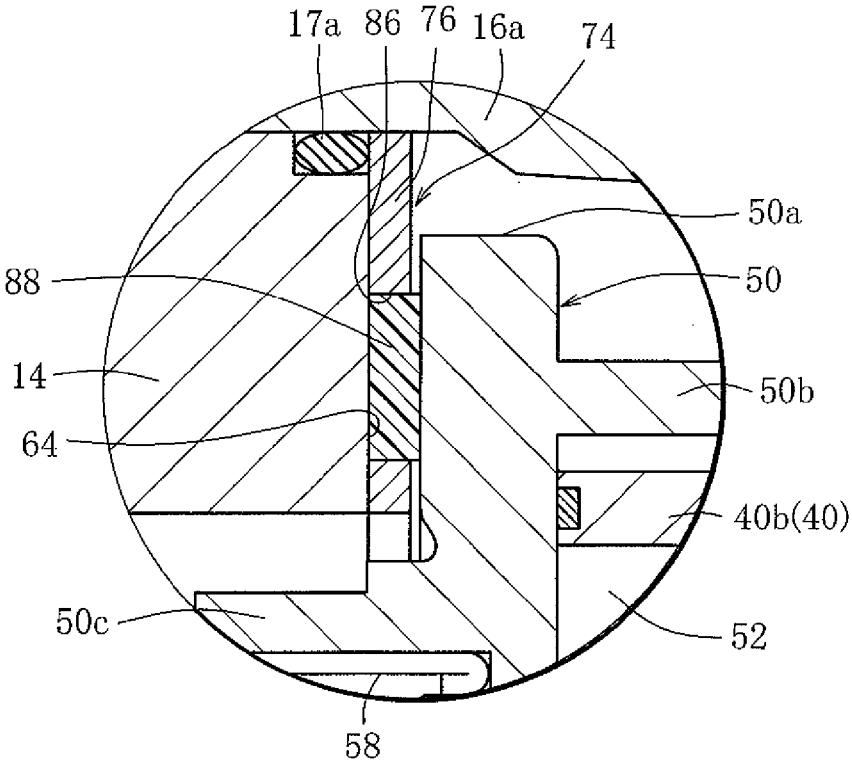
FIG. 4 is a view showing a thrust bearing and its vicinity shown in FIG. 1, in an enlarged scale.

A thrust bearing 74 for supporting the thrust load transmitted from the movable scroll 50 is placed in between the movable scroll 50 and the support wall 14. Referring to FIG. 4, the thrust bearing 74 has a retention plate 76 that is fixed in a state being in surface contact with the support face 64 of the support wall 14.

Figure 5:
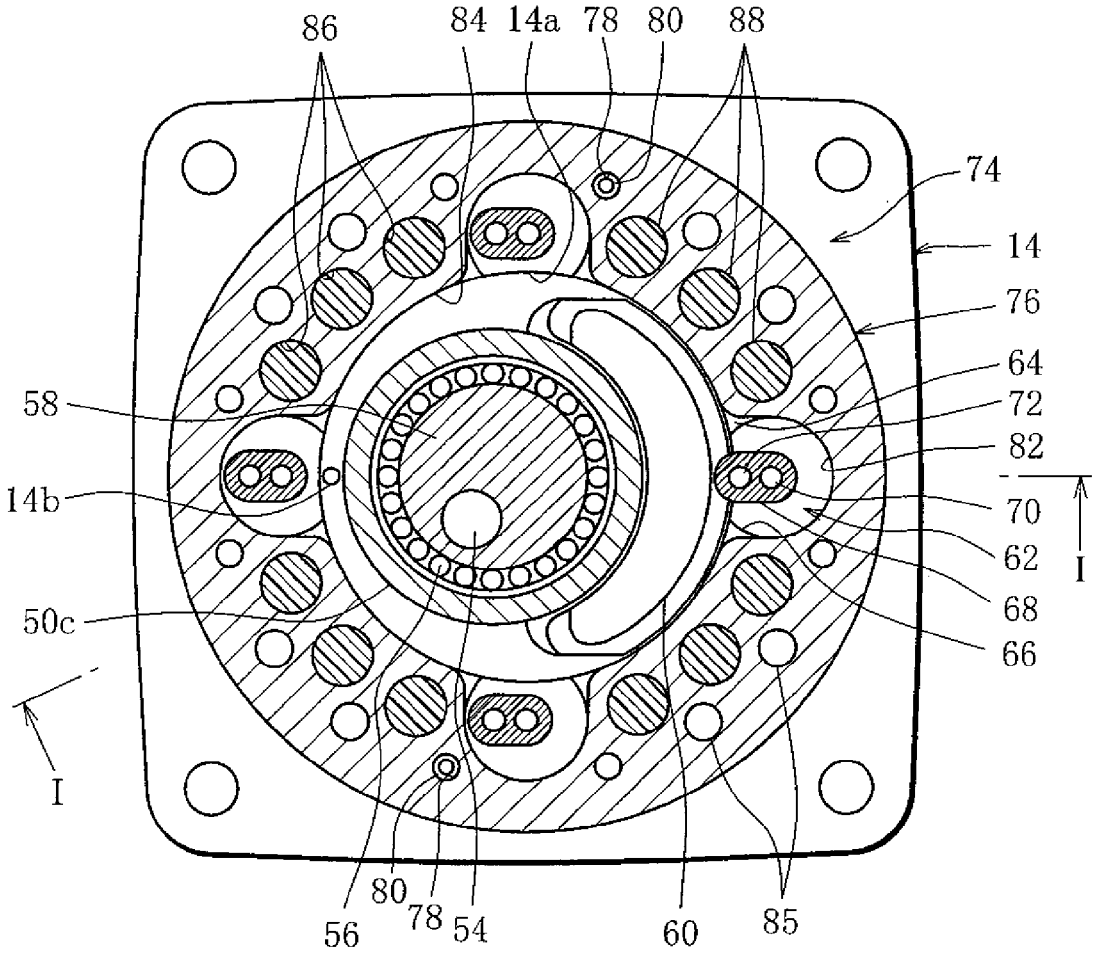
FIG. 5 is a cross sectional view, taken along line V-V of FIG. 1.
Figure 6:
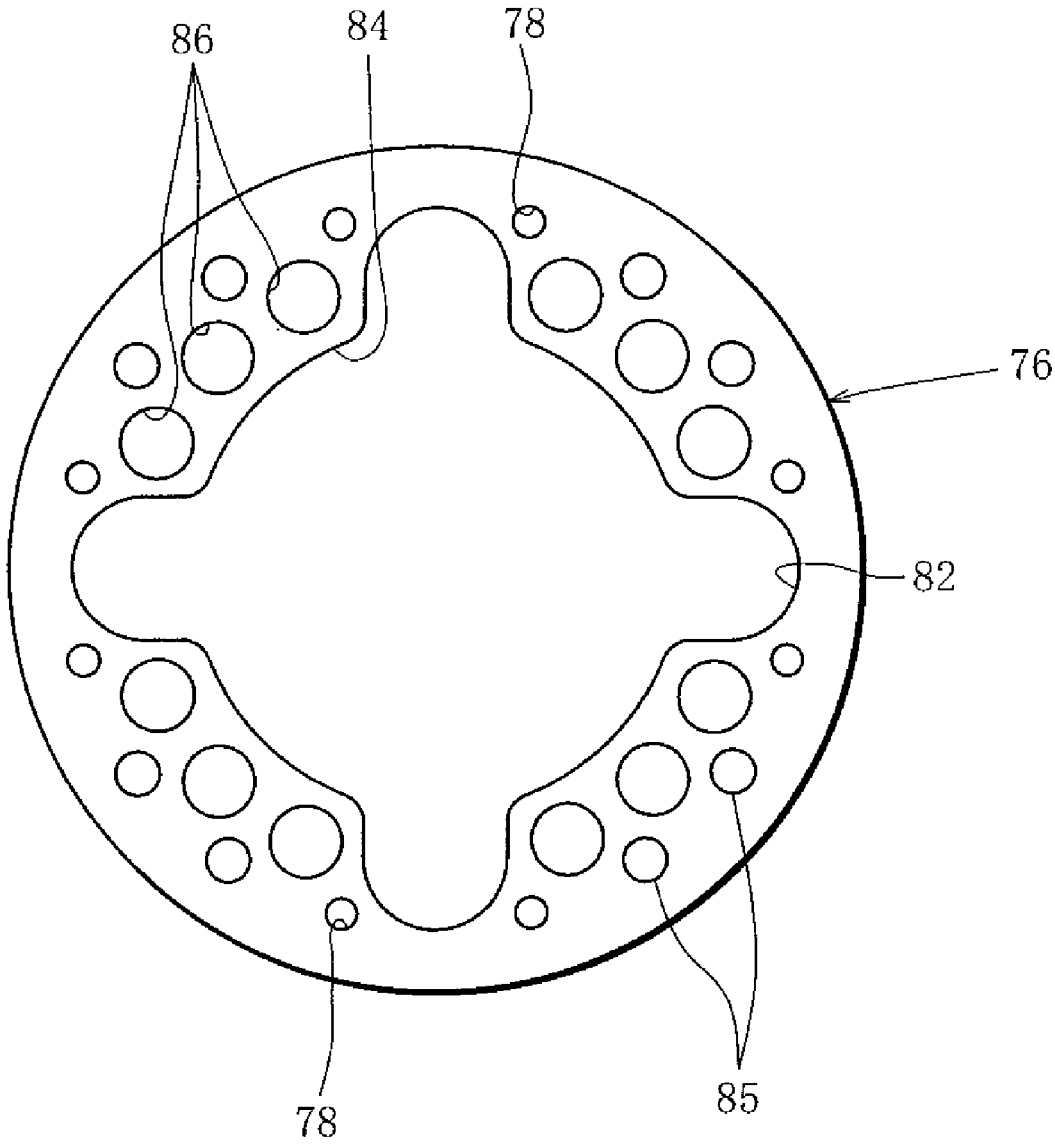
FIG. 6 is a plan view showing a retention plate that is used in the thrust bearing shown in FIG. 4.

More specifically, as illustrated in FIGS. 5 and 6, the retention plate 76 is formed in a shape of a ring that substantially coincides with a planar shape of the support face 64, and has a plurality of engagement holes 78. Engagement pins 80 protruding from the support face 14 are fitted into the engagement holes 78. The retention plate 76 is fixed onto the support face 64, prohibiting a relative rotation due to the engagement holes 78 and the engagement pins 80.

In the retention plate 76, four substantially circular cut-out portions 82 are formed so as to coincide with the shapes and positions of the recesses 66 of the support wall 14. An inner edge of the retention plate 76 accordingly has a shape that is formed by combining substantially circular circumferential edges of the four cut-out portions 82 with four circular arcs 84 connecting the circumferential edges of the cut-out portions 82 to one another and having the same curvature as the shaft hole 14*a*. The retention plate 76 does not hamper the function of the rotation stoppers 62.

In the retention plate 76, a plurality of intake holes 85 are formed so as to coincide with the positions of open ends of the communication holes 14*c* that open in the support wall 64. Accordingly, spaces existing across the support wall 14 communicate with each other through the communication holes 14*c* and the intake holes 85.

The retention plate 76 has twelve retention holes 86, which open in both faces of the retention plate 76. The retention holes 86 each have a circular shape. The retention holes 86 are arranged so that each three of them are located in an area between the two corresponding adjacent cut-out portions 77 at regular intervals. The retention plate 76 is not particularly limited in material, but is preferably made of synthetic resin.

Cylindrical flat pressure-receiving pieces 88 are rotatably fitted in the respective retention holes 86. The pressure-receiving pieces 88 may be made of metal, ceramic, synthetic resin, synthetic rubber or the like. Considering moldability, however, the pressure-receiving pieces 88 are preferably made of synthetic resin.

Referring to FIG. 4 again, the pressure-receiving piece 88 has thickness larger than thickness of the retention plate 76, or depth of the retention hole 86. One of end faces of the pressure-receiving piece 88 is in surface contact with the support face 64, whereas the other end of the pressure-receiving piece 88 is protruding from the retention hole 86. The other end face of the pressure-receiving piece 88, which is protruding from the retention hole 86, comes into surface contact with the back face of the base plate 50*a* of the movable scroll 50. The thickness of the retention plate 76 is larger than a protruding length of the engagement pin 80 projecting from the support face 14, so that the engagement pin 80 and the movable scroll 50 do not interfere with each other.

As illustrated in FIG. 4, the support face 64 side of the support wall 14 is formed as a small-diameter portion with a diameter smaller than an internal diameter of the outer circumferential wall 16*a* of the scroll casing 16. The O-ring 17*a* is fitted in a ring groove marked off in between the outer circumferential wall 16*a* and the small-diameter portion. An outer circumferential portion of the retention plate 76 covers the ring groove to function as a pressing plate for pressing the O-ring 17*a* fitted in the ring groove.

In the above-described compressor, when the stator 22 is supplied with power, the armature 26, namely the rotary shaft 30, starts rotating. The rotational movement of the rotary shaft 30 is converted into the orbiting movement of the movable scroll 50. Along with the orbiting movement, a series of processes is implemented, including the steps of drawing the refrigerant into the pressure chamber 52, compressing the refrigerant within the pressure chamber 52, and discharging the refrigerant from the pressure chamber 52 into the discharge chamber 42. In other words, the refrigerant is drawn from the low-pressure side of the refrigeration circuit into the compressor and is discharged from the high-pressure side of the refrigeration circuit after being compressed in the compressor.

With the above-mentioned thrust bearing 74, the pressure-receiving pieces 88 are dragged by the base plate 50*a* of the movable scroll 50 during the orbiting movement of the movable scroll 50 and then rotated within the retention holes 86. The pressure-receiving pieces 88 accordingly slide against either one or both of the sliding surfaces of the support face 64 and the base plate 50*a* of the movable scroll 50.

In the thrust bearing 74 used in the above compressor, the pressure-receiving pieces 88 are brought into surface contact with the support face 64 of the support wall 14 and the base plate 50*a* of the movable scroll 50 in a state retained in the retention holes 86 of the retention plate 76. This eliminates the necessity of forming the retention hole or groove with a fixed depth in the support face 64. As long as the support face 64 is ground flat, the sliding faces of the pressure-receiving pieces 88, which come into sliding contact with the movable scroll 50, can be arranged flush with one another. Consequently, the thrust bearing 74 of the above compressor is capable of uniformly applying the pressure-receiving pieces 88 with thrust load transmitted from the movable scroll 50, to prevent a fracture, abrasion, seizure or the like of the pressure-receiving pieces 88, and to secure a good sliding ability with a simple structure.

In the thrust bearing 74 of the above compressor, the form of the support wall 14 or scroll casing 16 having the ring groove for accommodating the O-ring 17*a* is simplified by pressing the O-ring 17*a* with the outer circumferential portion of the retention plate 76. The compressor is then easy to be manufactured and sold at a low price.

In the above compressor, the support wall 14 separates the drive casing 14 accommodating an electric motor from the scroll casing 16 accommodating the fixed and movable scrolls 40 and 50, and the intake port 18 is formed in the drive casing 14. However, the refrigerant smoothly flows around the fixed and movable scrolls 40 and 50 through the communication holes 14*c* and the intake holes 85, to thereby efficiently supply the refrigerant to the pressure chamber 52. The lubricating oil contained in the refrigerant is also sufficiently supplied to the fixed and movable scrolls 40 and 50, efficiently lubricating the sliding part between the scrolls 40 and 50. The compressor therefore maintains durability and reduces power consumption.

In the above compressor, the lubricating oil is smoothly supplied through the lubricating-oil supply hole 14*b* to a joint part between the boss 50*c* and the rotary shaft 30, that is, the clank pin 54, the eccentric bushing 56, and the needle bearing 58. The compressor therefore maintains durability and reduces power consumption.

In the above compressor, since the retention plate 76 is made of resin, it is easy to mold the retention plate 76. The compressor is then easy to be manufactured and sold at a low price. The resin retention plate 76 is light in weight, and contributes to weight saving of the compressor. A vehicle or the like employing this compressor is improved in fuel consumption.

The invention is not limited to the above-described one embodiment, and may be modified in various ways.

For example, the compressor of the one embodiment includes the electric motor formed of the stator 22, the coil 24 and the armature 26 in the drive casing 12. Instead of the electric motor, however, a pulley or an electromagnetic clutch may be rotatably disposed outside the drive casing. In this case, a portion of the drive casing, which supports the pulley or the electromagnetic clutch rotatably, is formed as a small-diameter portion. A bearing is interposed between the small-diameter portion and the pulley or the electromagnetic clutch. The pulley or the electromagnetic clutch is connected to an end portion of the rotary shaft 30, which is protruding from the drive casing.

According to the one embodiment, the retention plate 76 has the flat ring-like shape. However, the retention plate 76 is not particularly limited in shape and thickness as long as the retention plate 76 is capable of retaining the pressure-receiving pieces 88 and does not interfere with the movable scroll 50 and the rotation stopper 62. Although the retention plate 76 functions to press the O-ring 17*a*, the retention plate 76 does not have to serve as a presser.

According to the one embodiment, each of the pressure-receiving pieces 88 has a circular shape in planar view. However, the planar shape of each of the pressure-receiving pieces 88 is not particularly limited and may be an arc-like shape. In this connection, the shape of the retention holes 86 of the retention plate 76, which retain the pressure-receiving pieces 88, may be properly changed to match with the planar shape of the pressure-receiving pieces 88. For example, the retention holes 86 may have a groove-like shape extending in a shape of an arc.

Although, in the one embodiment, the engagement pins 80 are protruding from the support face 64, the engagement pins 80 may have roots fitted in holes formed in the support face 64 or may be integrally protruding from the support face 64. It is also possible to form the engagement pins integrally with the retention plate 76 and engage the engagement pins with engagement holes formed in the support face 64.

According to the one embodiment, the lubricating-oil supply hole 14*b* and the communication holes 14*c* are formed in the support wall 14, and the intake holes 85 in the retention plate 76. However, it is not necessarily required to provide the lubricating-oil supply hole 14*b*, the communication holes 14*c* and the intake holes 85.

Needless to say, the scroll-type fluid machine of the invention is usable not only as a compressor for a refrigeration circuit that is installed in a vehicle airconditioning system but as a compressor or an expander employed in various fields.

The invention claimed is:

1. A scroll-type fluid machine comprising:

a fixed scroll that is fixed in a housing with an intake port and a discharge port;

a movable scroll that forms pressure chambers in between the movable and fixed scrolls and is orbitable relative to the fixed scroll;

a support wall that is provided for the housing and supports thrust load transmitted from the movable scroll; and a thrust-receiving device that is disposed in between the movable scroll and the support wall, the thrust-receiving device including:

a ring-shaped support face formed in the support wall, a retention plate fixed onto the support face, a retention hole that is formed in the retention plate and opens into both faces of the retention plate, and a pressure-receiving piece that is retained in the retention hole and comes into surface contact with both the support face and the movable scroll, wherein a planar shape of the retention hole matches a planar shape of the pressure-receiving piece such that the pressure-receiving piece is fitted in the retention hole and retained by the retention plate.

2. The scroll-type fluid machine according to claim 1, further comprising:

the housing includes a scroll casing that is airtightly connected to the support wall with an O-ring interposed therebetween and accommodates the fixed scroll;

the retention plate is formed in a shape of a ring; and an outer circumferential portion of the retention plate presses the O-ring.

3. The scroll-type fluid machine according to claim 2, wherein the housing further includes a drive casing that is airtightly connected to the scroll casing through the support wall and encloses at least a part of a rotary shaft that transmits motive power for causing the movable scroll to make orbiting movement;

the intake port is formed in the drive casing; and the scroll-type fluid machine further has a communication hole extending through the support wall and the retention plate.

4. The scroll-type fluid machine according to claim 3, wherein the support wall has:

a shaft hole inserted with a boss of the movable scroll from one side and an end of the rotary shaft from the other side;

a reduced bore portion that is formed in the other side of the shaft hole, the reduced bore portion to which a bearing for supporting the rotary shaft is fixed; and a lubricating-oil supply hole extending through the reduced bore portion.

5. The scroll-type fluid machine according to claim 2, wherein the housing further includes a drive casing that is airtightly connected to the scroll casing through the support wall and encloses at least a part of a rotary shaft that transmits motive power for causing the movable scroll to make orbiting movement;

the intake port is formed in the drive casing; and the support wall has:

a shaft hole inserted with a boss of the movable scroll from one side and an end of the rotary shaft from the other side;

a reduced bore portion that is formed in the other side of the shaft hole, the reduced bore portion to which a bearing for supporting the rotary shaft is fixed; and a lubricating-oil supply hole extending through the reduced bore portion.

6. The scroll-type fluid machine according to claim 1, wherein the housing further includes a drive casing that is airtightly connected to the scroll casing through the support wall and encloses at least a part of a rotary shaft that transmits motive power for causing the movable scroll to make orbiting movement;

the intake port is formed in the drive casing; and the scroll-type fluid machine further has a communication hole extending through the support wall and the retention plate.

7. The scroll-type fluid machine according to claim 6, wherein the support wall has:

a shaft hole inserted with a boss of the movable scroll from one side and an end of the rotary shaft from the other side;

a reduced bore portion that is formed in the other side of the shaft hole, the reduced bore portion to which a bearing for supporting the rotary shaft is fixed; and a lubricating-oil supply hole extending through the reduced bore portion.

8. The scroll-type fluid machine according to claim 1, wherein the housing further includes a drive casing that is airtightly connected to the scroll casing through the support wall and encloses at least a part of a rotary shaft that transmits motive power for causing the movable scroll to make orbiting movement;

the intake port is formed in the drive casing; and the support wall has:

a shaft hole inserted with a boss of the movable scroll from one side and an end of the rotary shaft from the other side;

a reduced bore portion that is formed in the other side of the shaft hole, the reduced bore portion to which a bearing for supporting the rotary shaft is fixed; and a lubricating-oil supply hole extending through the reduced bore portion.

9. The scroll-type fluid machine according to claim 1, wherein the retention plate is made of resin.

10. A scroll-type fluid machine comprising:

a fixed scroll that is fixed in a housing with an intake port and a discharge port;

a movable scroll that forms pressure chambers in between the movable and fixed scrolls and is orbitable relative to the fixed scroll;

a support wall that is provided for the housing and supports thrust load transmitted from the movable scroll; and a thrust-receiving device that is disposed in between the movable scroll and the support wall, the thrust-receiving device including:

a ring-shaped support face formed in the support wall, a retention plate fixed onto the support face, a retention hole that is formed in the retention plate and opens into both faces of the retention plate, and a pressure-receiving piece that is retained in the retention hole and comes into surface contact with both the support face and the movable scroll, wherein the support wall has:

a shaft hole inserted with a boss of the movable scroll from one side and an end of a rotary shaft that transmits motive power for causing the movable scroll to make orbiting movement from the other side;

a reduced bore portion that is formed in the other side of the shaft hole, the reduced bore portion to which a bearing for supporting the rotary shaft is fixed; and a lubricating-oil supply hole extending through the reduced bore portion.

* * * * *